United States Patent [19]

Pali

[11] Patent Number: 4,575,017

[45] Date of Patent: Mar. 11, 1986

[54] PASTER TAB AND METHOD OF USE

[75] Inventor: Christopher Pali, Fort Wayne, Ind.

[73] Assignee: Essex Group, Inc., Fort Wayne, Ind.

[21] Appl. No.: 617,307

[22] Filed: Jun. 4, 1984

[51] Int. Cl.[4] ..... B65H 19/18

[52] U.S. Cl. ..... 242/58.3; 242/58.5; 156/504; 156/157

[58] Field of Search ..... 242/58.3, 58.5; 24/67 AR; 156/157, 250, 504, 505, 502, 509

[56] References Cited

U.S. PATENT DOCUMENTS

| | | | |
|---|---|---|---|
| Re. 26,528 | 2/1969 | Anderson | 242/58.3 |
| 2,160,855 | 6/1939 | Ginsburg et al. | 242/58.5 |
| 2,320,656 | 6/1943 | Roesen | 242/58.5 |
| 2,386,345 | 10/1945 | Roesen | 242/58.2 |
| 2,413,581 | 12/1946 | Roesen | 242/58.3 |
| 2,812,145 | 11/1957 | Meloche | 242/58.5 |
| 3,001,735 | 9/1961 | Francik | 242/58.5 |
| 3,138,476 | 6/1964 | Phipps | 428/80 |
| 3,231,949 | 2/1966 | Phipps | 242/58.5 X |
| 3,391,877 | 7/1968 | Angell et al. | 242/58.3 |
| 3,547,739 | 12/1970 | Beute | 156/504 |
| 3,724,033 | 4/1973 | Baker | 242/58.5 |
| 3,787,264 | 1/1974 | Underwood | 156/505 X |
| 3,861,612 | 1/1975 | Kubo | 242/58.3 |
| 4,181,847 | 1/1980 | Buschmann et al. | 242/58.3 |
| 4,415,127 | 11/1983 | Seragnoli | 242/58.1 |

FOREIGN PATENT DOCUMENTS

| | | | |
|---|---|---|---|
| 422211 | 1/1935 | United Kingdom | 242/58.5 |

*Primary Examiner*—John M. Jillions

*Attorney, Agent, or Firm*—Robert P. Hayter

[57] ABSTRACT

A paster tab for releasably securing the beginning end of a roll of material to the first layer of the roll is disclosed. The paster tab includes a color contrast area suitable for optical detection to orient the paper roll. The paster tab further includes a weakened portion for promoting separation of the paster tab between the areas secured to the beginning end of the new roll and the first layer of the roll. A method of splicing the trail end of an expiring ribbon to the beginning end of a new roll of ribbon is further disclosed including adhesively securing the trail end of the old ribbon to both the top of the beginning end of the new ribbon and to a portion of the paster tab.

6 Claims, 8 Drawing Figures

FIG. 6
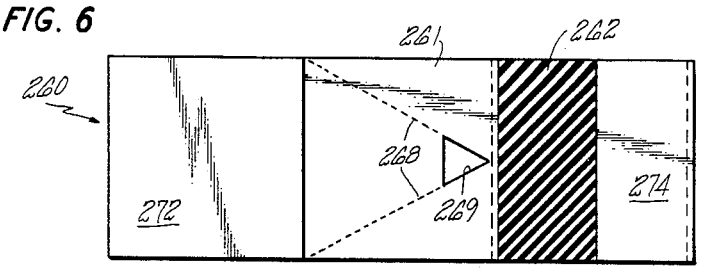
FIG. 7
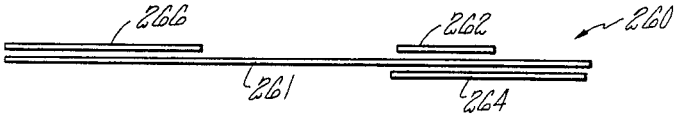
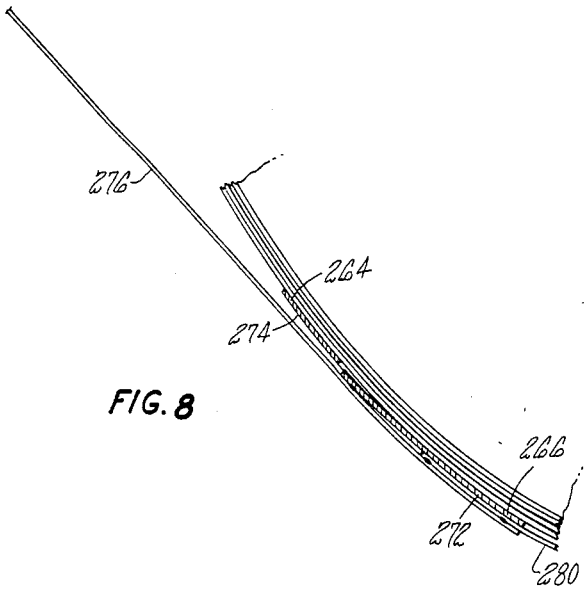
FIG. 8

PASTER TAB AND METHOD OF USE

BACKGROUND OF THE INVENTION

The present invention concerns a paster tab suitable for securing the beginning end of a roll of material to the first layer of the roll. More particularly the present invention concerns a paster tab suitable for securing the beginning end of a roll of material to the first layer of material, a weakened portion for promoting separation of the two ends of the paster tab and a color contrast area for allowing optical detection for appropriate orientation of the paper roll or other roll of material.

Utilization of a paster tab to secure the loose end of the paper roll to the next layer is known in the art. Such tabs are used to prevent the unwinding of the paper roll.

The paster tab as utilized herein serves numerous functions. As will be explained in more detail later the paster tab serves to secure the loose beginning end of a roll to the first layer thereof such that a multiplicity of rolls may be mounted with their loose ends secured on a conveyor assembly for subsequent removal from the conveyor assembly. Additionally these paster tabs may serve as an alignment indicator such that all the paper rolls being mounted on a conveyor assembly may be mounted with the paster tab in the same orientation to promote subsequent removal from the conveyor assembly by a robot assembly.

Additionally the paster tab includes a color contrast area printed on a top portion of the downstream section of the paster tab such that it is visible to an optical detector. The robot assembly includes an optical detector for sensing the color contrast area of the paper tab to appropriately orient the roll of material when being mounted to a payoff assembly. By maintaining this orientation as desired the trail end of an expired roll may be secured to the exact position desired.

Additionally this paster tab is designed to be secured to the bottom of the beginning of the new roll and the top of the first layer such that it is arranged therebetween. The beginning of the new roll terminates prior to the color contrast area such that the color contrast area is not covered. In addition a weakened portion is provided between an upstream section and a downstream section of the paster tab to promote separation of the downstream and upstream sections upon the paper ribbon being advanced such that the paster tab separates and the continuous ribbon is supplied from the payoff assembly.

SUMMARY OF THE INVENTION

An object of the present invention is to provide a paster tab for securing the beginning end of a roll of material to the first layer thereof.

Another object of the present invention is to provide a paster tab including means which may be optically detected to appropriately orient the roll of material to which the tab is secured.

A still further object of the present invention is to provide a paster tab including a weakened portion to promote separation of the paster tab upon the ribbon of roll material being advanced.

Another object of the present invention is to provide a method of securing the trail end of an expired roll to the beginning end of a new roll of material.

A still further object of the present invention is to provide appropriate upstream and downstream sections of the paster tab and means for precisely orienting the roll of material with the attached paster tab such that the trail end of the expiring roll may be secured to both the beginning end of the new roll and the upstream section of the paster tab prior to the weakened area whereby upon the trail end of the old ribbon being advanced a force will be applied to both the beginning end of the new ribbon and the paster tab to effect separation of the upstream and downstream sections of the paster tab.

A yet further object of the present invention is to provide a safe, economical, reliable and consistent means for orienting a roll of material, for securing the end of the roll of material to the first layer of the roll of material and for promoting separation of the paster tab upon an appropriate force being applied.

Other objects will be apparent from the description to follow and the appended claims.

The above objects are achieved according to the preferred embodiment by the provision of a paster tab for releasably securing the beginning end of a roll of material to the first layer of the roll. The paster tab includes a tab body divided into an upstream section and a downstream section, an upstream adhesive portion located on the top side of the upstream section such that the bottom of the beginning end of the new roll may be secured thereto, a downstream adhesive portion located on the bottom side of the downstream portion such that the top of the first layer may be secured thereto, and a color contrast area on the top side of the downstream section, said area being optically detectable for use in orienting the roll.

Additionally disclosed is a roll of material incorporating a paster tab secured to affix the beginning end of the new roll to the first layer thereof.

Further disclosed is a method of joining the trail end of an expiring ribbon to the beginning end of a roll of new ribbon wherein a paster tab secures the beginning end of the new ribbon to a first layer on the roll, the paster tab includes a color contrast area and the paster tab has upstream and downstream sections separated by a weakened tab body portion. The method includes the steps of placing adhesive on the trail end of the expiring roll in a preselected area, contacting the preselected area of the expiring roll with the adhesive to the top of the beginning end of the new roll on the opposite side of the ribbon from where the paster tab is secured and with the upstream portion of the paster tab, and advancing the ribbon causing the weakened portion of the tab body to separate leaving the upstream section of the tab body and the beginning end of the new roll secured to the trail end of the old roll to create a continuous ribbon. Further disclosed is the step of orienting the new paper roll in the desired position by sensing the position of the color contrast area of the paster tab.

BRIEF DESCRIPTION OF THE DRAWINGS

FIG. 6 is a top view of the paster tab.

FIG. 7 is a side view of the paster tab.

FIG. 8 is an enlarged side view of the trail end of the expiring ribbon being secured to the beginning end of the new ribbon.

DESCRIPTION OF THE PREFERRED EMBODIMENT

Figure 1:
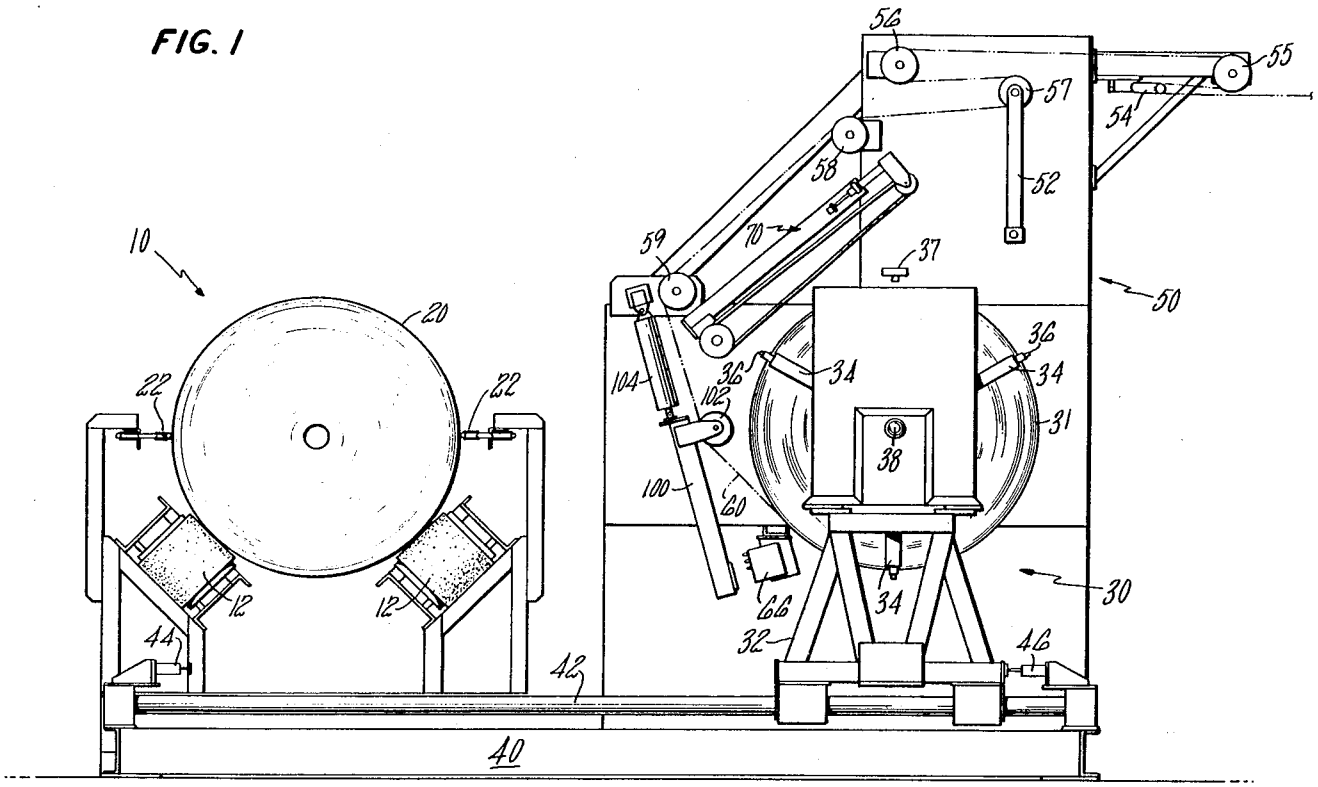
FIG. 1 is a front plan view of a conveyor assembly, robot assembly and paper payoff assembly.
Figure 2:
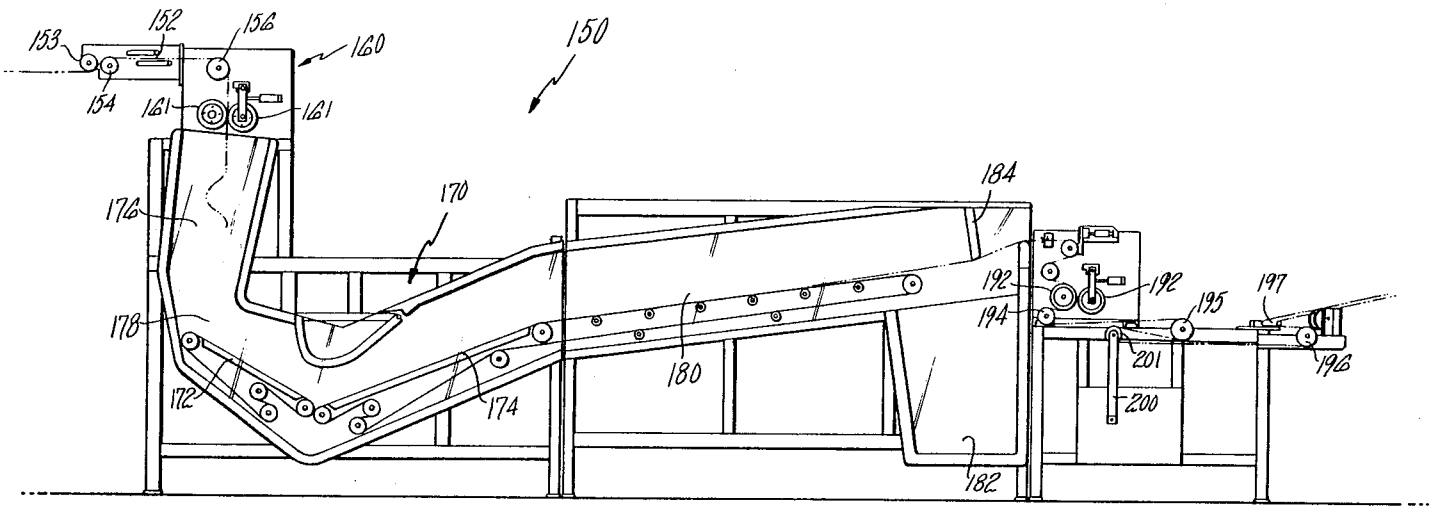
FIG. 2 is a front plan view of a ribbon feeder and accumulator assembly and feed-up assembly.

Referring to FIGS. 1 and 2 there may be seen a front plan view and a partial top view of a complete ribbon feed system for supplying paper ribbon from large rolls of ribbon to an end use at a high rate of speed. It is anticipated that ribbon as required for a particular use may come in rolls up to three feet in diameter and may be of varying widths. The specific use for which the herein equipment was designed is to supply paper to a wire production facility. This paper ribbon typically has a width between one and one and a half inches. It is desirable to supply the paper at speeds in the 2,000–5,000 feet per minute range. This ribbon supply system could, of course, be used for other applications and with rolls of paper stock or other ribbon material of varying sizes.

Each paper roll of the dimensions mentioned contains approximately 17,000 lineal feet of paper. At the desired unwinding speeds an individual paper roll is completely consumed in 4–9 minutes. The equipment herein is designed to allow another roll to be mounted automatically and joined to the previous roll such that the wire production facility may operate continuously including operating without interruption when paper rolls are being changed. Absent such automatic machinery it would be necessary to provide attendants for the purpose of loading paper rolls.

FIG. 1 is a front plan view of a conveyor assembly, a paper payoff assembly and a robot assembly. Conveyor assembly 10 consists of two parallel mounted conveyor belts 12 having a series of paper rolls 20 stacked vertically therebetween. The length of the conveyor belts depends upon the number of paper rolls desired to be mounted on the conveyors at one time. The length is theoretically unlimited. The conveyor assembly includes means to advance the conveyor belts to move paper rolls 20 forward to a position where robot assembly 30 may grasp and remove the roll from the conveyor belts. Position sensors 22 are shown located one on either side of the paper roll to indicate that the paper roll has been advanced to a pickup position. The conveyor belts are typically operated to advance the paper rolls until the position sensors are tripped by contact with the paper roll.

Robot assembly 30 is mounted on rails 42 for left-to-right motion as seen in FIG. 1. Position stops 44 and 46 are utilized to control the position of robot assembly 30. Robot assembly 30 includes arms 34 containing clamp jaw mechanisms for securing paper roll 31. Optical detector 37 is mounted to this portion of the robot assembly and acts to sense the position of a darkened color contrast area on a paster tab securing the beginning end of the paper roll to the remainder of the paper roll. A central shaft for allowing rotation of the entire paper roll is further provided. The robot assembly may traverse to the left, mechanically grasp and remove a paper roll from the conveyor assembly, and thereafter traverse to the right until aligned with the paper payoff assembly. The robot assembly then acts to position the paper roll on paper payoff assembly 50. Once the paper roll is on paper payoff assembly 50 paper ribbon 60 is directed over pulleys 102, 59, 58, 57, 56, and 55 serially. The ribbon then passes over angle bar 54 and continues to the ribbon feeder and accumulator assembly 150 of FIG. 2. Paper payoff assembly 50 further includes a paster arm assembly 100, glue applicator 66, drive belt assembly 70, and dancer arm 52. The paster arm assembly includes apparatus for holding and cutting the ribbon after a paper roll has been unwound. Glue applicator 66 is utilized to provide adhesive to the trail end of the consumed paper roll such that the trail end of the ribbon from the consumed paper roll may be connected to the beginning portion of the ribbon of the new roll mounted on the paper payoff assembly by the robot assembly.

Drive belt assembly 70 consists of a drive belt operated to rotate the paper roll at a desired speed of supply ribbon to the end use. The ribbon passes over pulley 57 which is mounted on dancer arm 52. The position of dancer arm 52 is used to control the speed of drive belt 70 for regulating the payoff rate of ribbon 60.

FIG. 2 is a front plan view of a ribbon feeder and accumulator assembly 150. The ribbon feeder and accumulator assembly is utilized to store sufficient ribbon such that during the time interval between the consumption of one paper roll and the mounting of a new paper roll by the robot assembly, the process to which the paper is supplied may continue to operate with paper being continuously supplied from the ribbon feeder and accumulator assembly. To supply paper for this interval when no paper is being unwound, it is necessary to store a sufficient quantity of paper that operation of the end use may continue. Under the circumstances described it might be appropriate to store from 1,000–5,000 lineal feet of paper ribbon in the feeder and accumulator assembly.

The ribbon feeder and accumulator assembly includes stacking box 170 having feed chute 176, stacking area 178 and storage area 180. Ribbon is supplied through pulleys 153 and 154, through static eliminator 152 and around pulley 156 to feed wheels 161. Feed wheels 161 direct the ribbon into the stacking area and include urethane tire-like portions for effectively stiffening the ribbon such that it is directed in a straight path resulting in the ribbon being folded in large loops in the stacking area. Stacks of ribbon from the stacking area are conducted by ramp conveyor belt 172 downwardly and to the right. Storage conveyor belt 174 then directs the stacks of ribbon into storage area 180. The pack lean reversing shoe is positioned to create a resistance at a top portion of the folds such that as the folds of paper are switched from ramp conveyor belt 172 to storage conveyor belt 174 the direction of lean of the folds is reversed. Reversing the direction of lean of the paper in the storage area allows the paper to be removed from the storage area without pulling the paper from the bottom of the pack thereby reducing the force required to physically pull the paper from the storage area. Spill box 182 is utilized to store excess folds when inadvertently dumped thereinto. Fold stripper 184 acts to remove the folds from the paper.

A feed up assembly includes supply wheels 192 for supplying paper to the end use at the desired rate, pulleys 194, 195, 196, 197 and dancer 200 having pulley 201. The position of dancer 200 is sensed and thereafter used to regulate the supply wheels to control the rate of feed of paper ribbon to the end use. The remaining pulleys simply act to guide the paper through the feed-up assembly.

Figure 3:
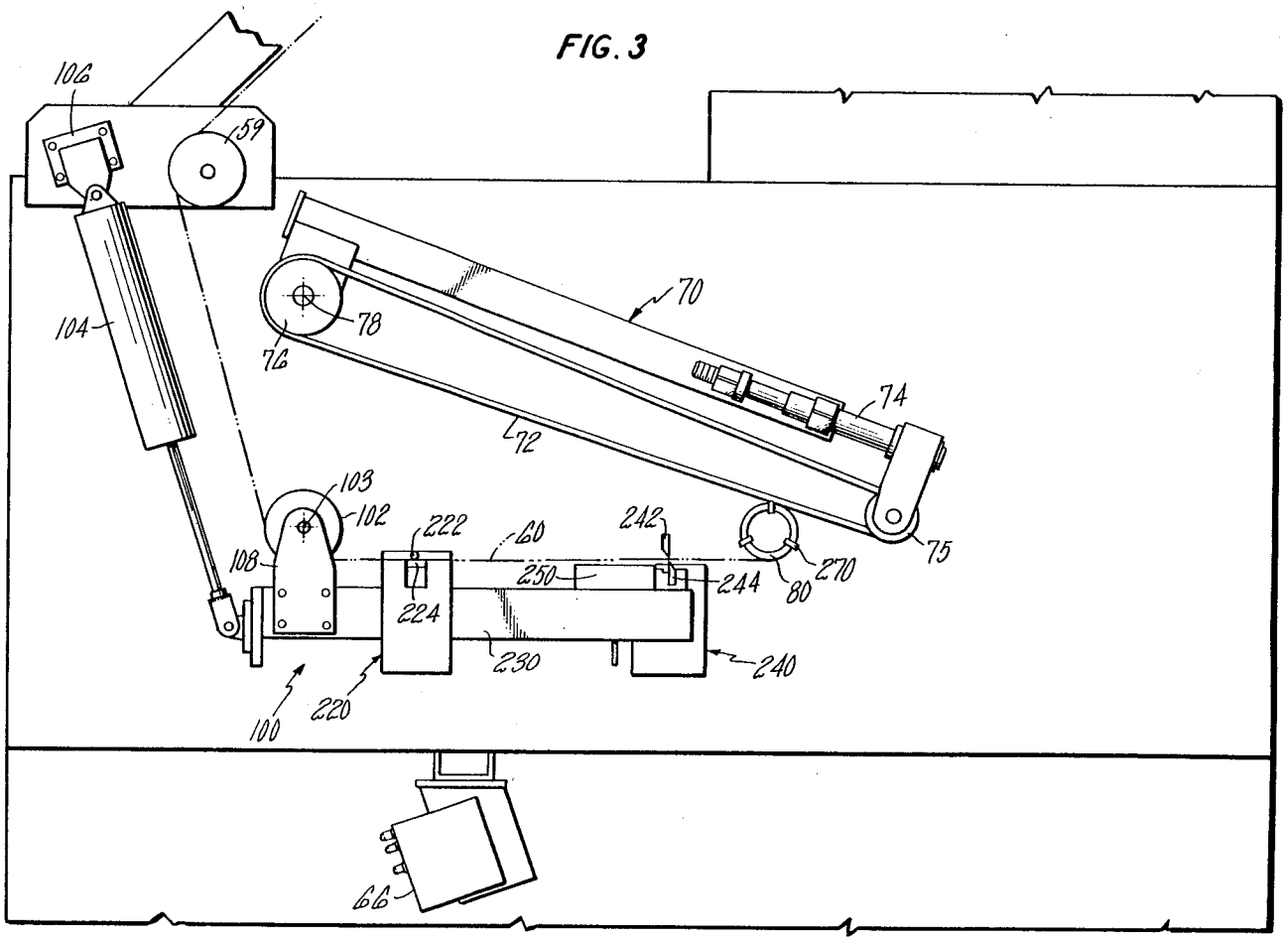
FIG. 3 is a partial front view of the payoff assembly showing the paster arm in the ribbon cutting position.

Paster arm assembly 100 is shown in a raised position in FIG. 3. In this position it may be seen that ribbon clamp assembly 220 includes a clamp bar 222 positioned to secure ribbon 60 between the clamp bar and clamp pad 224. Additionally vacuum cup 250 may be seen extending from paster arm assembly 100. This vacuum cup is made slightly arcuate to be configured to mate with the exterior surface of a full paper roll and includes on the surface thereof a neoprene type convering having a myriad of small holes through which a vacuum is drawn to secure the ribbon relative thereto.

Positioned on the paster arm immediately downstream from the vacuum cup is ribbon knife assembly 240 including knife blades 242 and 244 which may be actuated to sever ribbon 60. Actuator 104 is shown connected between pivot support 106 and the main portion of the paster arm assembly. The paster arm assembly is connected via arm support 108 to pulley 102. Pivot point 103 is the pivot point for pulley 102 and also the pivot point of the main portion of the paster arm assembly. Hence, when the actuator is energized and extends, the paster arm rotates about pivot point 103 to swing upwardly to be in alignment with the ribbon such that the ribbon may be clamped, secured by the vacuum cup and cut by the knife. Glue applicator 66 is shown at the bottom of the drawing and is mounted to slide in and out when appropriate.

In the position as shown in FIG. 3 the paper roll has been used up and the drive belt assembly is deenergized to bring the paper roll to a stop. The paster arm actuator is energized to rotate the paster arm up and the ribbon clamp assembly and ribbon knife assembly are actuated as will be explained later such that the clamp assembly secures the ribbon in position maintaining the tension in the ribbon between the ribbon clamp assembly and the dancer arm, the vacuum cup acts to secure the end of the ribbon and the knife assembly cuts the ribbon between paper roll 80 and the portion of the ribbon secured by the vacuum cup.

Figure 4:
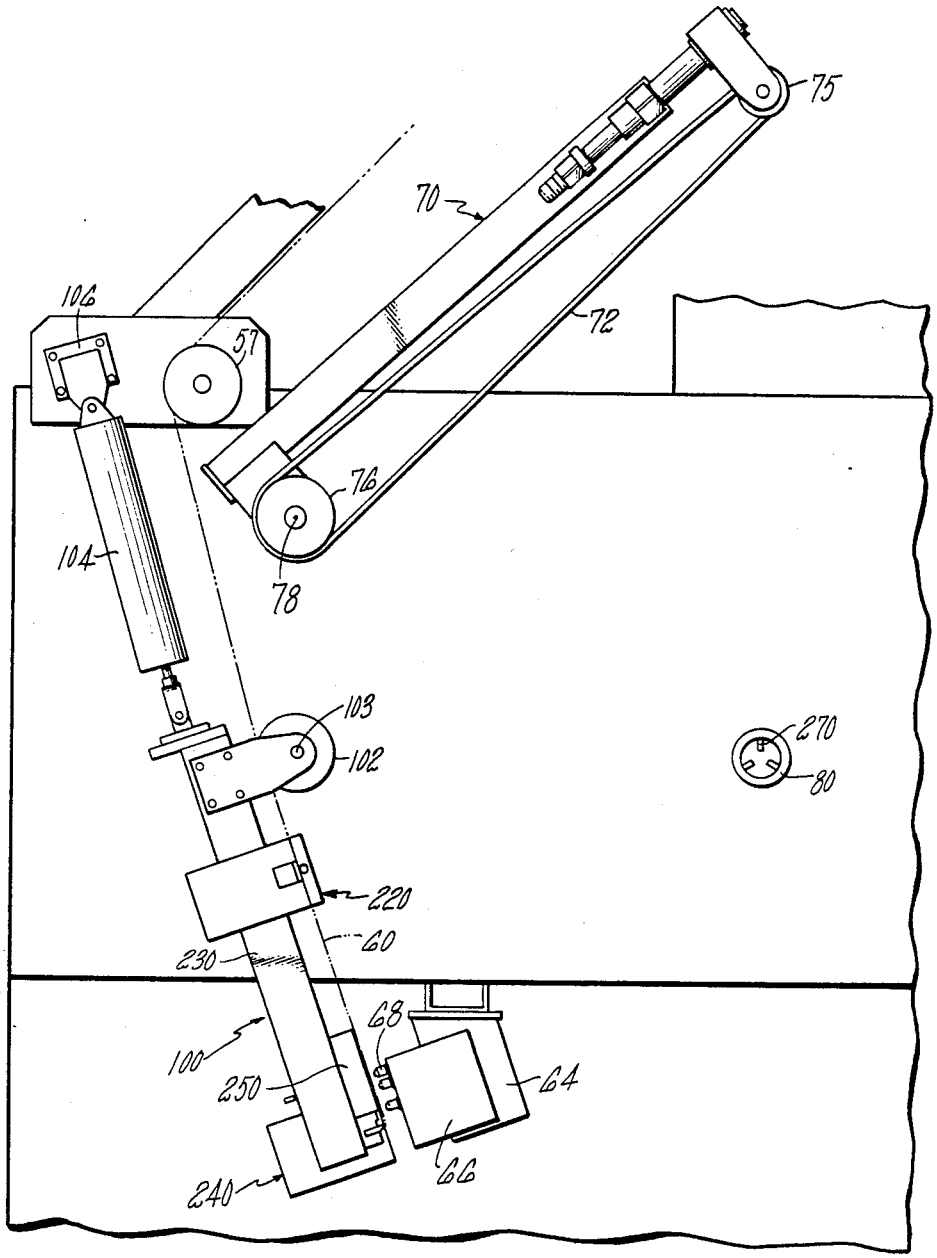
FIG. 4 is a partial front view of the payoff assembly showing the paster arm in position for the glue applicator to apply adhesive to the trail end of the expiring ribbon.

Referring now to FIG. 4 it may be seen that paper roll 80 is released from the paper payoff assembly by withdrawing core latch gears 270 and the core latch chuck assembly through the core of the paper roll such that the paper roll drops to the floor.

Drive belt assembly 70 has been raised upwardly such that it is withdrawn from the area in which a new paper roll will be mounted. Paster arm actuator 104 has been energized to cause the paster arm to rotate downwardly. The ribbon remains clamped by ribbon clamp assembly 220 and the end thereof is held in position by vacuum cup 250. In this position glue applicator 66 secured by slidable support 64 is displaced outwardly to align with the end of the ribbon secured by the vacuum cup. Nozzles 68 connected to the glue applicator 66 act to guide the application of the adhesive to selected spots on the end of the ribbon as secured by the vacuum cup.

Figure 5:
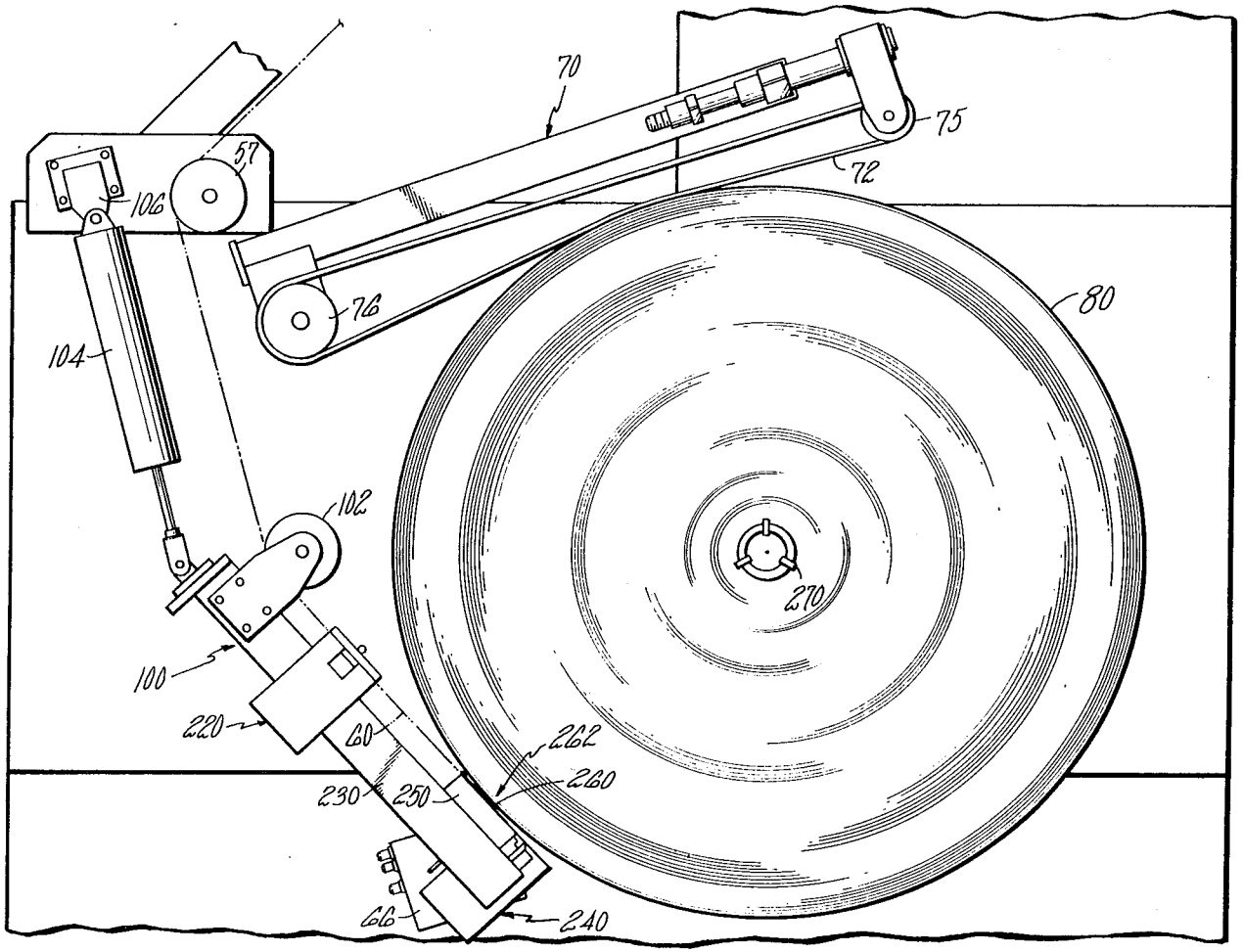
FIG. 5 is a partial front plan view of the payoff assembly showing the paster arm in position to fasten the trail end of the old ribbon to the beginning end of the new ribbon and the paster tab.

Referring now to FIG. 5 it may be seen that a new paper roll 80 has been placed in position by the robot assembly and that the core chuck assembly has been reinserted through the paper core and that chuck gears 270 extend outwardly securing the paper roll in position. It may additionally be seen that drive belt assembly 70 has been rotated downwardly to engage the top of the paper roll such that it is in position to start rotating the paper roll when desired.

Actuator 104 of the paster arm assembly 100 has been slightly extended such that the paster arm rotates upwardly until it contacts the exterior wrap of paper roll 80. Paster tab 260 is shown mounted on the exterior of the paper roll and includes an index line 262 which has been previously utilized by the robot assembly to place the paster tab in position to be secured to the trail end of the ribbon. The trail end of the ribbon remains secured by the vacuum cup and is contacted with the paster tab and the beginning end of the new roll such that the adhesive supplied by glue applicator 66 acts to secure the trail end of ribbon 60 to paster tab 260 and the beginning end of paper roll 80. Clamp assembly 220 is deenergized such that the ribbon is not longer clamped and the vacuum cup is additionally deenergized. At this point the actuator of paster arm assembly acts to remove the paster arm assembly back to its original position as shown in FIG. 1. Operation of the paper payoff assembly may now be recommenced with the drive belt acting to rotate the paper roll at the desired speed and the dancer acting to control that speed. Tension of the ribbon between the dancer arm and the new paper roll has been maintained since the clamp assembly maintained tension until the tail end of the old ribbon was secured to the new paper roll. Upon energization of the drive belt assembly the paster tab separates with a portion of the paster tab and the new paper roll being secured to the tail end of the old paper roll such that a continuous paper ribbon is supplied to the end use. During this changeover interval when no paper is being supplied the paper stored in the feeder and accumulator is utilized.

During normal unwinding operation the paster arm is in position as shown in FIG. 1 for guiding ribbon from the paper roll. Upon the paper roll being depleted the paster arm advances to the position shown in FIG. 3 for clamping the ribbon and severing the ribbon. Once the ribbon is severed, the paster arm moves to the position shown in FIG. 4 to enable the application of adhesive to the ribbon and to allow the robot assembly to provide a new paper roll to the paper payoff assembly. The paster arm then moves to the position shown in FIG. 5 to join the old ribbon to the new ribbon. Thereafter the paster arm retracts to the position shown in FIG. 1 until the replacement cycle is needed again.

Referring now to FIGS. 6 through 8 the paster tab and the manner of its use are more accurately described. FIG. 6 is a top view of paster tab 260 showing a tab made from a paper-type material having an upstream section 272 and a downstream section 274. The paster tab 260 includes a printed dark portion 262, two sets of lineal perforations 268 defining a generally triangular portion and a cut and removed triangle 269. Hence, a portion of the paster tab is removed to promote tearing of the paster tab along perforations 268.

FIG. 7 is a side view of the same paster tab. Therein paster tab 260 is shown having dark printed line 262 on the top thereof in the downstream portion and adhesive 264 on the bottom thereof. Adhesive 266 is placed at the top of the upstream portion 272. The manner of use of the particular adhesives and the tearaway portion will be described relative to FIG. 8.

FIG. 8 is a cutaway side view of the connection between the end of expiring ribbon 276 and the new paper roll. The new paper roll consists of the end of the new roll 280 and a first layer. The paster tab is utilized to secure the end of the paper roll to prevent it from unwinding prior to the paper roll being placed on the conveyor belt. The paster tab is secured to the paper roll with the adhesive 266 located on the top side of the upstream section of the paster tab being secured to the bottom of the end of the beginning of new roll 280. The adhesive 264 located on the bottom of the downstream section of the paster tab is secured to the top of first layer 278 of the roll. Hence, the paster tab is located between the bottom surface of the end of the first layer in the new roll and the top surface of the immediately adjacent layer. In this manner the paper roll is prevented from unwinding. Additionally in this manner the dark printed section is secured between the beginning of the new roll 280 and the first layer of the old roll 278. Additionally this dark portion is located upstream of the new roll.

Referring back to the manner in which the paster arm contacts the trailing edge of the old roll to the exterior surface of the new roll it is remembered that adhesive is applied to the surface of the old ribbon. This adhesive is applied such that upon rotation of the paster arm the adhesive will engage the top surface of the beginning of the new roll and the area defined between the perforations of the paster tab. In this manner the expiring ribbon 276 is secured to the top of the beginning of the new roll 280 and to the paster tab. Since it is secured to the paster tab between the perforated sections upon a small application of force to advance the expiring ribbon the paster tab separates at the perforated section with the upstream section 272 being secured to expiring ribbon 276 and to the beginning of new roll 280. Downstream section 274 simply remains with first layer 278 of the new roll. In this manner as the ribbon is accelerated the paster tab is separated and the ribbon from the old roll is joined to the ribbon of the new roll such that ribbon may be supplied continuously to the end use.

The invention has been described with reference to a particular embodiment. It is to be understood by those skilled in the art that variations and modifications can be effected within the spirit and scope of the invention.

I claim:

1. A paster tab for releasably securing the beginning end of a roll of material to the first layer of the roll which comprises:

a tab body divided into an upstream section and a downsteam section;

an upstream adhesive portion located on the top side of the upstream section such that the bottom of the beginning end of the new roll may be secured thereto;

a downstream adhesive portion located on the bottom side of the downstream section such that the top of the first layer may be secured thereto;

a dark color contrast area on the top side of the downstream section, said area being optically detectable for use in orienting the roll; and a weakened tab body portion formed between the upstream section and the downstream section for promoting separation of the upstream section from the downstream section, said body portion in the upstream section defining a triangular opening at the center of the tab body, and two outwardly diverging series of perforations extending from the triangular opening to the edges of the tab body.

2. The apparatus as set forth in claim 1 wherein the defined triangular opening has one point of the triangle extending in the long direction of the tab body and the two legs of the triangle forming the point are flared outwardly therefrom, said outwardly diverging series of perforations being extensions of the legs of said triangular opening.

3. A roll of material which comprises a beginning end and a multiplicity of helically wound layers, and a paster tab having a tab body with an upstream section including an adhesive portion affixed to the bottom of the beginning end, a downstream section having an adhesive portion affixed to the top of the first layer of the roll, a dark color contrast area on the top of the downstream section of the tab where it is optically detectable, a weakened tab body portion for facilitating separation of the downstream section from the upstream section, said weakened tab body portion including a triangular opening located at the center of the tab body and two outwardly diverging series of perforations which are extensions of two sides of the triangular opening and extend from the triangular opening to the edges of the tab body.

4. The apparatus as set forth in claim 3 wherein the beginning end extends only over the upstream section.

5. A method of joining the trail end of an expiring ribbon to the beginning end of a roll of new ribbon wherein a paster tab secures the beginning end of the new ribbon to a first layer on the roll, the paster tab including a dark color contrast area and the paster tab having upstream and downstream sections separated by a weakened tab body portion which comprises the steps of:

placing adhesive on the trail end of the expiring roll in a preselected area;

contacting the preselected area of the expiring roll with the adhesive to the top of the beginning end of the new roll on the opposite side of the ribbon from where the paster tab is secured and with the upstream portion of the paster tab including that portion of the paster tab in the weakened tab body portion which is in contact with the upstream section of the paster tab; and advancing the ribbon causing the weakened portion of the tab body to separate leaving the upstream section of the tab body and the beginning end of the new roll secured to the trail end of the old roll to create a continuous ribbon.

6. The method as set forth in claim 5 and further comprising the step of:

orienting the new paper roll in the desired position by sensing the position of the dark color contrast area on the paster tab.

* * * * *